US007647659B2

(12) United States Patent
Frolik et al.

(10) Patent No.: US 7,647,659 B2
(45) Date of Patent: Jan. 19, 2010

(54) TELESCOPIC LIFTER MAINLY DESIGNED FOR HEIGHT ADJUSTMENT OF A HOSPITAL BED

(75) Inventors: Zbynek Frolik, Slany (CZ); Miroslav Fejt, Kladno 4 (CZ); Vladimir Kolar, Slany (CZ)

(73) Assignee: Linet Spol. S R.O., Slany (CZ)

( * ) Notice: Subject to any disclaimer, the term of this patent is extended or adjusted under 35 U.S.C. 154(b) by 2 days.

(21) Appl. No.: 12/097,249

(22) PCT Filed: Mar. 5, 2007

(86) PCT No.: PCT/CZ2007/000014

§ 371 (c)(1),
(2), (4) Date: Jun. 12, 2008

(87) PCT Pub. No.: WO2007/112704

PCT Pub. Date: Oct. 11, 2007

(65) Prior Publication Data

US 2008/0263770 A1 Oct. 30, 2008

(30) Foreign Application Priority Data

Mar. 31, 2006 (CZ) ..... PUV 2006-17581

(51) Int. Cl.
*A47B 23/02* (2006.01)
*A47C 31/00* (2006.01)
*A47B 7/00* (2006.01)
*E06C 1/00* (2006.01)

(52) U.S. Cl. ..... 5/509.1; 5/11; 5/611; 182/69.4

(58) Field of Classification Search ..... 378/194, 378/197; 5/611, 11, 509.1; 182/69.4; 254/336, 254/337, 285, 286, 47, 385, 387, 389; 187/251, 187/252

See application file for complete search history.

(56) References Cited

U.S. PATENT DOCUMENTS

| | | | | |
|---|---|---|---|---|
| 3,289,870 | A * | 12/1966 | Quayle | 187/228 |
| 3,596,736 | A * | 8/1971 | Crawford | 182/148 |
| 3,902,070 | A * | 8/1975 | Amor et al. | 378/194 |
| 4,041,320 | A | 8/1977 | Amor, Jr. et al. | |
| 4,589,642 | A | 5/1986 | Schnelle et al. | |
| 4,590,720 | A * | 5/1986 | Reed | 254/336 |
| 6,074,075 | A * | 6/2000 | Staniec | 362/250 |
| 6,234,453 | B1 * | 5/2001 | Block | 254/285 |
| 6,942,198 | B2 * | 9/2005 | Huang | 254/387 |
| 7,588,232 | B2 * | 9/2009 | Wei et al. | 254/337 |
| 2008/0247516 | A1 * | 10/2008 | Fink et al. | 378/194 |

FOREIGN PATENT DOCUMENTS

EP 0982018 A2 3/2000

* cited by examiner

*Primary Examiner*—Peter M Cuomo
*Assistant Examiner*—Brittany M Wilson
(74) *Attorney, Agent, or Firm*—Hovey Williams LLP

(57) ABSTRACT

A telescopic lifter, mainly for height adjustment of a hospital bed, equipped with a drive (4) and including a first extensible part (1) is concentrically arranged. In the first extensible part (1) at least one second extensible part (2) is concentrically arranged. Inside the first extensible part (1) in the area of its upper end (6) a guide (7) is installed. Inside the second extensible part (2) in the area of its lower end (8) a holder (9) is installed. An electric cable (5) is attached to the fixed part (3) and freely passes into the inner space of the first extensible part (1) upwards to the guide (7) and over the guide (7). The electric cable is directed downwards to the holder (9) to which the electric cable (5) is firmly fixed and along the inner wall of the second extensible part (2); the electric cable (5) is directed out of the second extensible part (2).

4 Claims, 1 Drawing Sheet

TELESCOPIC LIFTER MAINLY DESIGNED FOR HEIGHT ADJUSTMENT OF A HOSPITAL BED

This is a national phase application of International application PCT/CZ2006/000014 filed 5 Mar. 2007, and claiming priority from Czech application no. PUV 2006-17581 filed 31 Mar. 2006, the disclosures of which are incorporated herein by reference.

TECHNICAL FIELD

The invention relates to a telescopic lifter, mainly for height adjustment of a hospital bed, equipped with a drive and comprising a fixed part in which a first extensible part is concentrically arranged and in the first extensible part at least one second extensible part is concentrically arranged.

BACKGROUND ART

Height-adjustable hospital or nursing beds use known telescopic lifters for the height adjustment, besides other lifting devices.

European patent EP 0982 018, the disclosure of which is incorporated by reference, deals with such a telescopic lifter containing a fixed part in which the first extensible part is concentrically arranged and in the first part another extensible part is concentrically arranged. At the upper end of the first extensible part a pulley is installed over which a chain is routed whose one end is attached to the fixed part and the other end is attached to the lower end of the other extensible part. Another pulley is attached to the lower end of the first extensible part and over it a chain is routed whose one end is attached to the upper end of the fixed part and the other end is attached to the upper end of the second extensible part. The drive may consist of a motion screw with a nut. In such a case in the lower part of the fixed part a worm gear is installed in a turning way on a bearing. The worm gear is firmly interconnected with the motion screw on which a nut is installed that is firmly connected to the first extensible part. The first extensible part is secured against turning with a vertical guide. An electric motor turns the worm gear via a worm and consequently the motion screw as well. Depending on the turning direction of the motion screw the action of the nut either slides the first extensible part upwards or downwards. At the same time the pulleys move, too, so rolling of the chains over the pulleys makes the other extensible part move in the same direction.

In known hospital or nursing beds with the possibility of positioning or height adjustment a lot of cables are routed between electric elements on the undercarriage of the bed (e.g. drive of a telescopic lifter or electric elements of the undercarriage) and electric elements on the patient surface of the bed (e.g. adjustment motors of the backrest or legrest or controls). These in principle loose cables represent the source of a lot of problems as during the adjustment of the position of the bed they may get damaged.

It is not possible to merely slip the cable through the inside of the known telescopic lifters as during the extension and retraction of the telescopic elements the electric cable may get damaged.

The aim of the invention is to modify the known lifter in such a way as to enable routing of a multi-conductor cable that interconnects electric elements on the undercarriage of the beds and electric elements on the patient surface through the lifter.

SUMMARY OF THE INVENTION

The above mentioned aim is achieved with a telescopic lifter, mainly for height adjustment of a hospital bed, equipped with a drive and comprising a fixed part in which a first extensible part is concentrically arranged while in the first extensible part at least one second extensible part is concentrically arranged, in accordance with the invention the principle of which is that Inside the first extensible part in the area of its upper end a guide is installed and inside the second extensible part in the area of its lower end a holder is installed. An electric cable is introduced into the fixed part and the electric cable is attached to the fixed part and freely passes into the inner space of the first extensible part. The electric cable is directed through the first extensible part upwards to the guide and over the guide the electric cable is directed downwards to the holder to which the electric cable is firmly fixed and along the inner wall of the second extensible part the electric cable is directed out of the second extensible part.

The structure of the telescopic lifter based on the invention allows to route the electric cable inside the telescopic lifter without tearing the electric cable apart during the extension of the telescopic lifter or conversely, uncontrolled accumulation of electric cable loops during retraction of the telescopic lifter.

In a preferred embodiment the guide may consist in a pulley or sliding guide.

BRIEF DESCRIPTION OF DRAWINGS

The telescopic lifter based on the invention will be described in a more detailed way with the use of a sample embodiment shown in the drawing, where.

Figures 1, 2, 3:
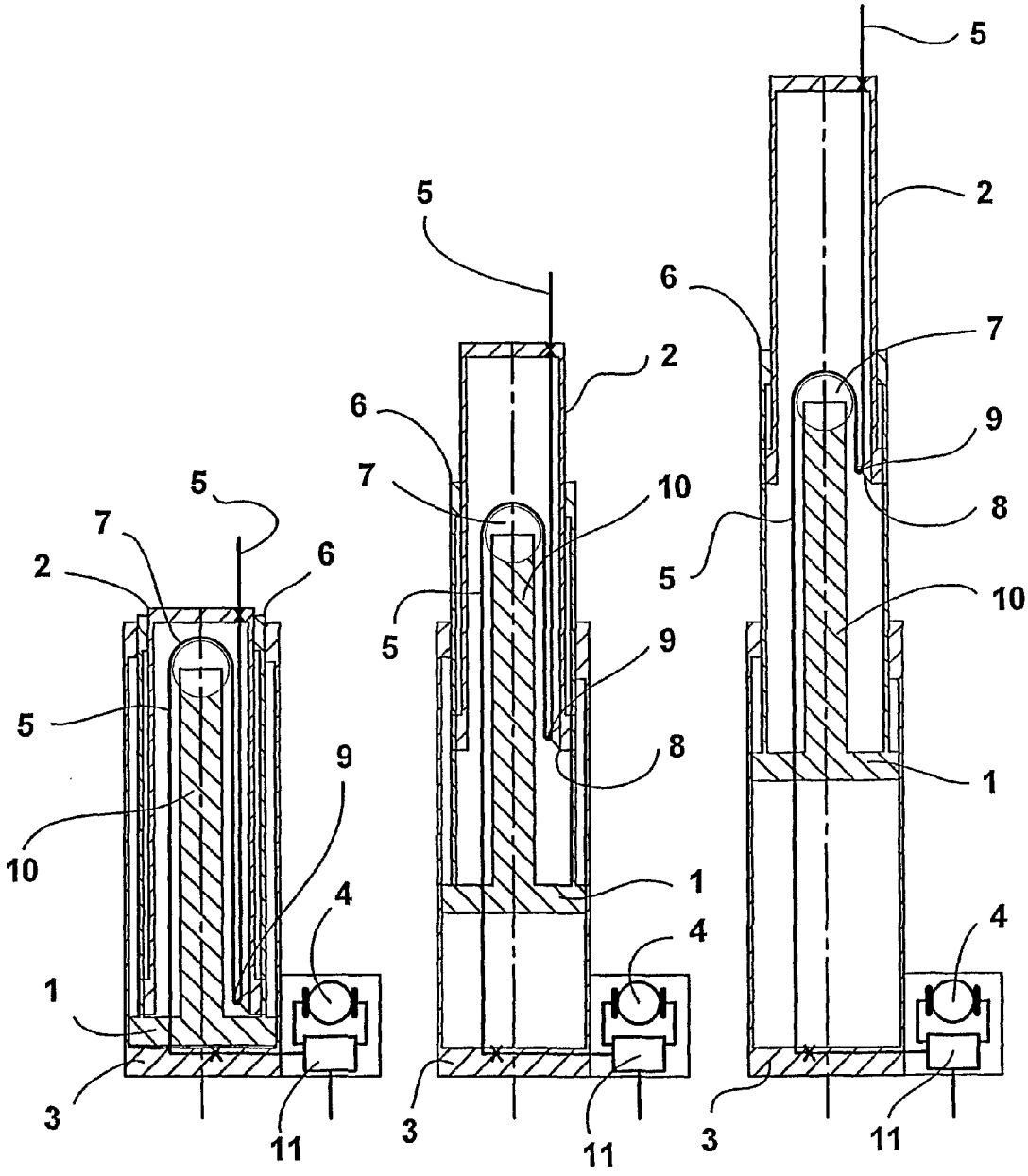
FIG. 1 represents the telescopic lifter in the retracted position.
FIG. 2 shows the same lifter in the intermediate position and FIG. 3 in the extended position.

For the sake of clarity the drawing does not show elements that cause simultaneous extension of all the extensible elements.

DESCRIPTION OF THE PREFERRED EMBODIMENT

The telescopic lifter shown in FIGS. 1, 2 and 3 comprises a fixed part 3 in which the first extensible part 1 is concentrically arranged and in the first extensible part 1 the second extensible part 2 is concentrically arranged.

The drive 4 is only represented schematically as an electric motor but experts find it obvious that any known drive can be used, e.g. a hydraulic motor. The fixed part 3 and the extensible parts 1, 2 are interconnected in such a way that when the drive 4 is actuated, the first extensible part 1 and the second extensible part 2 move simultaneously. Such an arrangement is commonly known from the state of the art and this is why it is not shown in the drawing and will not be described in a detailed way. As regards details, reference is made e.g. to European patent EP 0982 018.

Inside the first extensible part 1, in the area of its upper end 6 a guide 7 is installed on a support 10 connected to the first extensible part 1.

Inside the second extensible part 2, in the area of its lower end 8 a holder 9 is installed to fix the electric cable 5.

To interconnect several electric elements, it is advantageous to use a multi-conductor electric cable 5.

From the switchboard 11 the electric cable 5 is routed to the fixed part 3 to which it is attached. From the fixed part 3 the electric cable 5 freely passes into the internal space of the first extensible part 1 through which it is routed upwards to the guide 7.

In the depicted embodiment the guide 7 has the form of a pulley which is rotatably mounted on a support 10 parallel to the not shown pulley of the not shown chain of the mechanism for extending.

Over the guide 7 the electric cable 5 is turned by 180° and is routed downwards to the holder 9 on the second extensible part 2 to which it is firmly fixed. From the holder 9 the electric cable 5 is directed upwards along the inner wall of the second extensible part 2 to the upper section of the second extensible part 2, where it is fixed and directed to the surface of the bed, not shown here.

When the telescopic lifter is in the retracted position (see FIG. 1) and the electric motor of the drive 4 is actuated, the first extensible part 1 and the second extensible part 2 are extended simultaneously. Individual parts of the drive 4 that participate in the extension are not subject to the protection as they belong to the state of the art (see e.g. the above mentioned European patent EP 0982 018) and this is why they are neither shown in the drawings nor described in a detailed way.

During the simultaneous extension of the first extensible part 1 and the second extensible part 2 the electric cable rolls off the guide pulley 7 and at the same time it is fixed to the holder 9, which enables extension of the total length of the telescopic lifter without the electric cable 5 being torn apart.

During the retraction of the extensible parts 1, 2 the procedure is analogous while no uncontrolled accumulation of the electric cable 5 occurs.

The invention claimed is:

1. A telescopic lifter, adapted for height adjustment of a hospital bed, comprising:

a drive;

a fixed part a first extensible part having an upper end and concentrically arranged in the fixed part;

at least one second extensible part which has a lower end and an inner wall and is concentrically arranged in the first extensible part;

a guide installed inside the first extensible part in the area of its upper end;

a holder installed inside the second extensible part in the area of its lower end ; and an electric cable which is introduced into the fixed part, is attached to the fixed part and freely passes into the inner space of the first extensible part, is directed through the first extensible part upwards to the guide and over the guide, is directed downwards to the holder to which the electric cable is firmly fixed and along the inner wall of the second extensible part, and is directed out of the second extensible part.

2. The telescopic lifter according to claim 1, wherein the guide includes a pulley.

3. The telescopic lifter according to claim 2, wherein the guide has the form of a sliding guide.

4. The telescopic lifter according to claim 1, wherein the guide has the form of a sliding guide.

* * * * *